US007946058B2

(12) United States Patent
Johnson et al.

(10) Patent No.: US 7,946,058 B2
(45) Date of Patent: May 24, 2011

(54) ARTICLE OF FOOTWEAR HAVING A SOLE STRUCTURE WITH AN ARTICULATED MIDSOLE AND OUTSOLE

(75) Inventors: Daniel A. Johnson, Portland, OR (US); Chien-Yu Huang, Yun-Lin Hsien (TW)

(73) Assignee: NIKE, Inc., Beaverton, OR (US)

( * ) Notice: Subject to any disclaimer, the term of this patent is extended or adjusted under 35 U.S.C. 154(b) by 793 days.

(21) Appl. No.: 12/015,327

(22) Filed: Jan. 16, 2008

(65) Prior Publication Data

US 2008/0229617 A1 Sep. 25, 2008

Related U.S. Application Data

(60) Provisional application No. 60/896,102, filed on Mar. 21, 2007.

(51) Int. Cl.
*A43B 1/10* (2006.01)

(52) U.S. Cl. ..... 36/25 R; 36/102; 36/31

(58) Field of Classification Search ..... 036/25 R, 036/31, 30 R, 32 R, 102, 103, 114
See application file for complete search history.

(56) References Cited

U.S. PATENT DOCUMENTS

| | | | | |
|---|---|---|---|---|
| 4,130,947 | A | 12/1978 | Denu | |
| 4,151,661 | A * | 5/1979 | Namba et al. | 36/30 R |
| 4,309,832 | A | 1/1982 | Hunt | |
| 5,367,791 | A | 11/1994 | Gross et al. | |
| 5,384,973 | A | 1/1995 | Lyden | |
| 5,425,184 | A * | 6/1995 | Lyden et al. | 36/29 |
| 5,784,808 | A | 7/1998 | Hockerson | |
| 5,822,886 | A | 10/1998 | Luthi et al. | |
| 6,023,859 | A | 2/2000 | Burke et al. | |
| 6,065,230 | A | 5/2000 | James | |
| 6,115,945 | A | 9/2000 | Ellis, III | |
| 6,487,795 | B1 | 12/2002 | Ellis, III | |
| 6,915,596 | B2 | 7/2005 | Grove et al. | |
| 6,990,755 | B2 | 1/2006 | Hatfield et al. | |
| 7,171,767 | B2 * | 2/2007 | Hatfield et al. | 36/97 |
| 7,392,605 | B2 * | 7/2008 | Hatfield et al. | 36/97 |
| 7,430,817 | B2 * | 10/2008 | Abadjian et al. | 36/29 |
| 2005/0262739 | A1 | 12/2005 | McDonald et al. | |
| 2005/0268491 | A1 | 12/2005 | McDonald et al. | |
| 2006/0137221 | A1 | 6/2006 | Dojan et al. | |

(Continued)

FOREIGN PATENT DOCUMENTS

CN 1064395 A 9/1992

(Continued)

OTHER PUBLICATIONS

Office Action mailed on Jun. 10, 2010 in Chinese Patent Application No. 200880000040.9.

(Continued)

*Primary Examiner* — Marie Patterson
(74) *Attorney, Agent, or Firm* — Plumsea Law Group, LLC

(57) ABSTRACT

An article of footwear may have an upper and a sole structure secured to the upper. The sole structure includes a midsole and an outsole. The midsole has an upper surface and an opposite lower surface. The upper surface defines a plurality of depressions, and the lower surface defines a plurality of indentations extending toward the depressions. The outsole forms projections that extend into the indentations of the midsole, and the outsole has grooves located opposite the projections.

35 Claims, 15 Drawing Sheets

U.S. PATENT DOCUMENTS

| | | | | |
|---|---|---|---|---|
| 2007/0113426 | A1* | 5/2007 | Abadjian et al. | 36/29 |
| 2007/0169376 | A1* | 7/2007 | Hatfield et al. | 36/29 |
| 2007/0227038 | A1 | 10/2007 | Edington et al. | |
| 2007/0227040 | A1 | 10/2007 | Kilgore et al. | |
| 2009/0013558 | A1* | 1/2009 | Hazenberg et al. | 36/88 |

FOREIGN PATENT DOCUMENTS

| | | | |
|---|---|---|---|
| EP | 1832191 | A | 9/2007 |
| WO | 2004028285 | A | 4/2004 |
| WO | WO2004028285 | | 4/2004 |

OTHER PUBLICATIONS

Office Action issued on Jun. 10, 2010 in Chinese Invention Patent Application No. 200880000040.9.

International Search Report in PCT Application PCT/US2008/056631, mailed Jun. 18, 2008.

Office Action mailed Nov. 10, 2010 for Chinese Invention Patent Application No. 200880000040.9

* cited by examiner

ARTICLE OF FOOTWEAR HAVING A SOLE STRUCTURE WITH AN ARTICULATED MIDSOLE AND OUTSOLE

CROSS-REFERENCE TO RELATED APPLICATION

This non-provisional U.S. Patent Application claims priority under 35 U.S.C. §119(e)(1) to provisional U.S. Patent Application Ser. No. 60/896,102, which was filed in the U.S. Patent and Trademark Office on 21 Mar. 2007 and entitled An Article Of Footwear Having A Sole Structure With An Articulated Midsole And Outsole, such provisional U.S. Patent Application being entirely incorporated herein by reference.

BACKGROUND

Conventional articles of athletic footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces, the sole structure may provide traction, control foot motions (e.g., by resisting pronation), and impart stability, for example. Accordingly, the upper and the sole structure operate cooperatively to provide a comfortable structure that is suited for a wide variety of athletic activities.

The sole structure generally incorporates multiple layers that are conventionally referred to as an insole, a midsole, and an outsole. The insole is a thin, compressible member located within the upper and adjacent to a plantar (i.e., lower) surface of the foot to enhance footwear comfort. The midsole is conventionally secured to a lower surface of the upper and forms a middle layer of the sole structure that is primarily responsible for attenuating ground reaction forces. The outsole forms the ground-contacting element of the footwear and is usually fashioned from a durable, wear-resistant material that includes texturing to improve traction.

The conventional midsole is primarily formed from a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness and degree of ground reaction force attenuation may be altered to meet the specific demands of the wearer or of the activity for which the footwear is intended to be used.

In addition to polymer foam materials, conventional midsoles may include, for example, one or more fluid-filled chambers. In general, the fluid-filled chambers are formed from an elastomeric polymer material that is sealed and pressurized. The chambers are then encapsulated in the polymer foam of the midsole such that the combination of the chamber and the encapsulating polymer foam functions as the midsole of the sole structure. In some configurations, textile or foam tensile members may be located within the chamber or reinforcing structures may be bonded to an exterior or interior of the chamber to impart shape to the chamber.

SUMMARY

One example of the invention is an article of footwear having an upper and a sole structure secured to the upper. The sole structure includes a midsole and an outsole. The midsole may be formed from a polymer foam material that has an upper surface and an opposite lower surface. The upper surface is positioned adjacent to the upper, and the lower surface defines a plurality of indentations extending toward the upper surface. The outsole has an attachment surface and an opposite ground-engaging surface. The attachment surface is secured to the lower surface of the midsole, and the attachment surface forms a plurality of projections that extend into the indentations of the midsole. The ground-engaging surface defines a plurality of grooves located opposite the projections of the attachment surface.

In another example of the invention, the sole structure includes a midsole formed from a first material and having an upper surface and an opposite lower surface. The upper surface defines a plurality of depressions extending toward the lower surface, and the lower surface defines a plurality of indentations extending toward the upper surface. At least a portion of the depressions are positioned opposite the indentations. The sole structure also includes an outsole formed from a second material and at least partially located within the indentations. A compressibility of the second material is less than a compressibility of the first material.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

DETAILED DESCRIPTION

The following discussion and accompanying figures disclose an article of footwear, particularly a sole structure of the footwear, and methods for manufacturing the sole structure. Concepts related to the sole structure are disclosed with reference to footwear having a configuration that is suitable for the sport of basketball. The sole structure is not limited solely to footwear designed for basketball, however, and may be utilized with a wide range of athletic footwear styles, including running shoes, tennis shoes, football shoes, cross-training shoes, walking shoes, soccer shoes, and hiking boots, for example. The sole structure may also be utilized with footwear styles that are generally considered to be non-athletic, including dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

Figure 1:
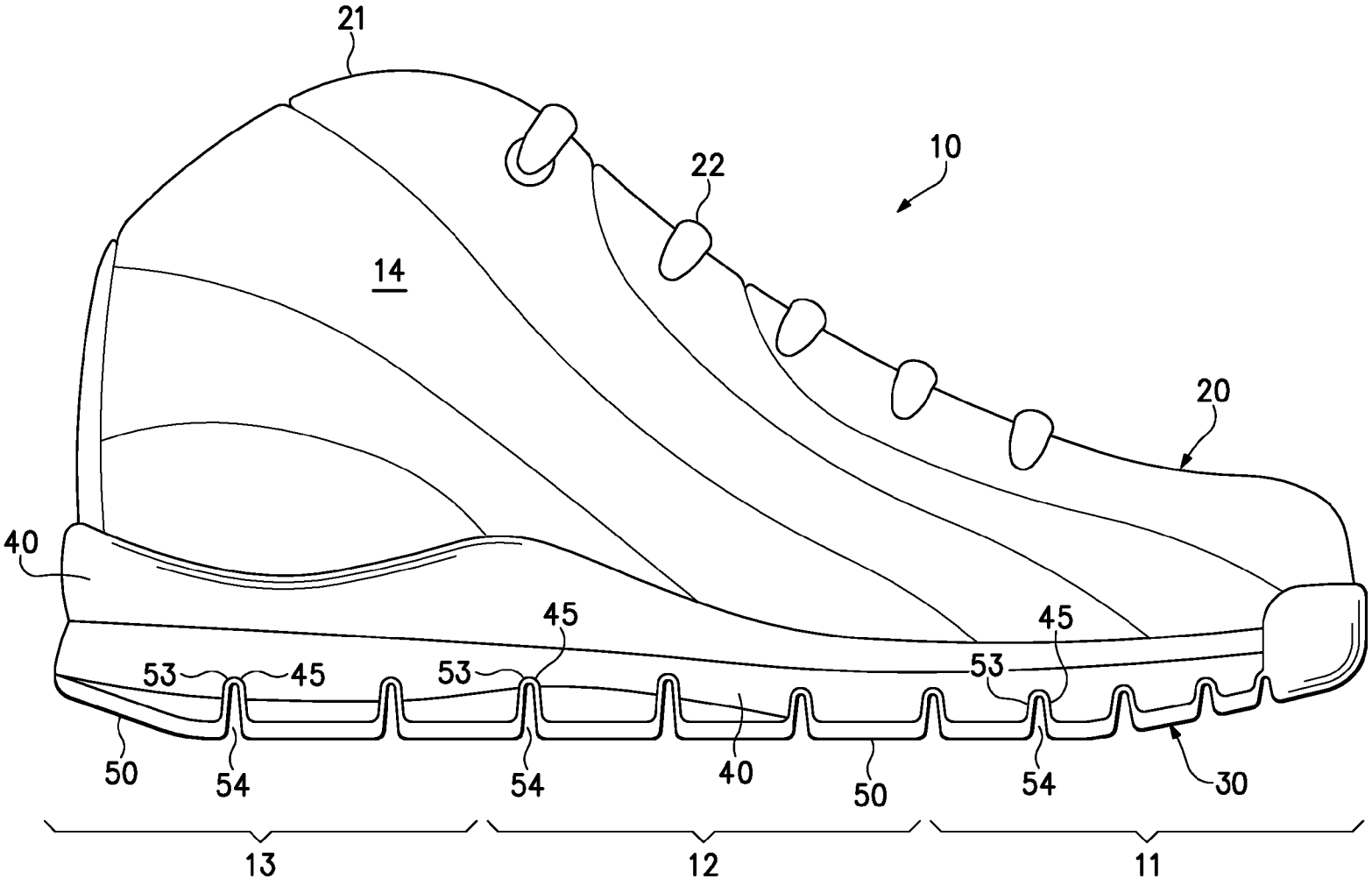
FIG. 1 is a lateral side elevational view of an article of footwear.
Figure 2:
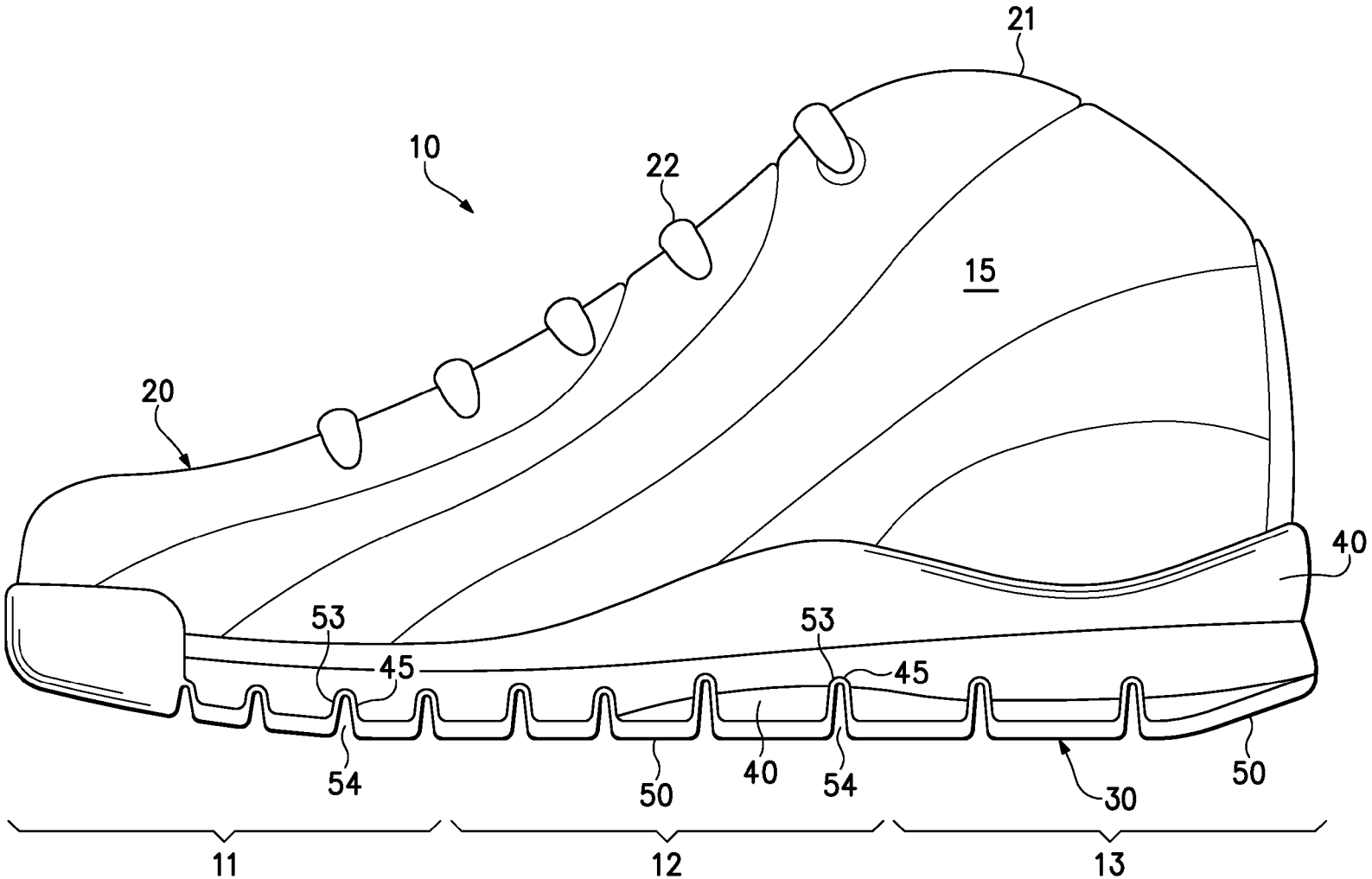
FIG. 2 is a medial side elevational view of the article of footwear.

An article of footwear 10 is depicted in FIGS. 1 and 2 as including an upper 20 and a sole structure 30. For reference purposes, footwear 10 may be divided into three general regions: a forefoot region 11, a midfoot region 12, and a heel region 13. Footwear 10 also includes a lateral side 14 and an opposite medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof.

Upper Configuration

Upper 20 is depicted as having a substantially conventional configuration incorporating a plurality material elements (e.g., textiles, foam, leather, and synthetic leather) that are stitched or adhesively bonded together to form an interior void for securely and comfortably receiving a foot. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22. Given that various aspects of the present application primarily relate to sole structure 30, upper 20 may exhibit the general configuration discussed above or the general configuration of practically any other conventional or non-conventional upper. Accordingly, the structure of upper 20 utilized with sole structure 30 or variants thereof may vary significantly within the scope of the present invention.

Sole Structure Configuration

Sole structure 30, which is depicted separate from upper 20 in FIGS. 3-7, is secured to upper 20 and extends between upper 20 and the ground. As discussed in greater detail below, sole structure 30 has an articulated configuration that enhances the overall flexibility of footwear 10, thereby permitting footwear 10 to flex or otherwise bend during walking, running, and other ambulatory activities. More particularly, sole structure 30 includes various flexion structures that may impart one or both of (a) lateral flexibility to permit the foot to pronate naturally during the running cycle and (b) longitudinal flexibility to ensure that the foot remains in a neutral foot-strike position and complement the forward roll of the foot as it is in contact with the ground.

The primary elements of sole structure 30 are a midsole 40 and an outsole 50. Midsole 40 is secured to a lower area of upper 20 (e.g., with stitching, adhesive bonding, or heat bonding) and extends through each of regions 11-13 and between sides 14 and 15. A variety of materials may be utilized for midsole 40, including a polymer foam material, such as polyurethane or ethylvinylacetate, that attenuates ground reaction forces as sole structure 30 is compressed between the foot and the ground. As depicted in FIGS. 1-6, midsole 40 is formed of unitary (i.e., one piece) construction from a single element of the polymer foam material that extends from upper 20 to outsole 50. As a unitary element, midsole 40 may be formed from two densities of the polymer foam material. For example, a rear-lateral area of midsole 40 may be formed from polymer foam material with a greater compressibility than a remainder of midsole 40. Outsole 50 is secured to a lower area of midsole 40 and forms a ground-engaging surface of footwear 10 that may include texturing to improve traction. In addition to midsole 40 and outsole 50, sole structure 30 may also include a variety of additional footwear elements, including plates, moderators, fluid-filled chambers, lasting elements, or motion control members, that enhance the performance of footwear 10. In some configurations, any of these additional footwear elements may be between midsole 40 and either of upper 20 and outsole 50, embedded within midsole 40, or encapsulated by the polymer foam material of midsole 40, for example.

Figure 3:
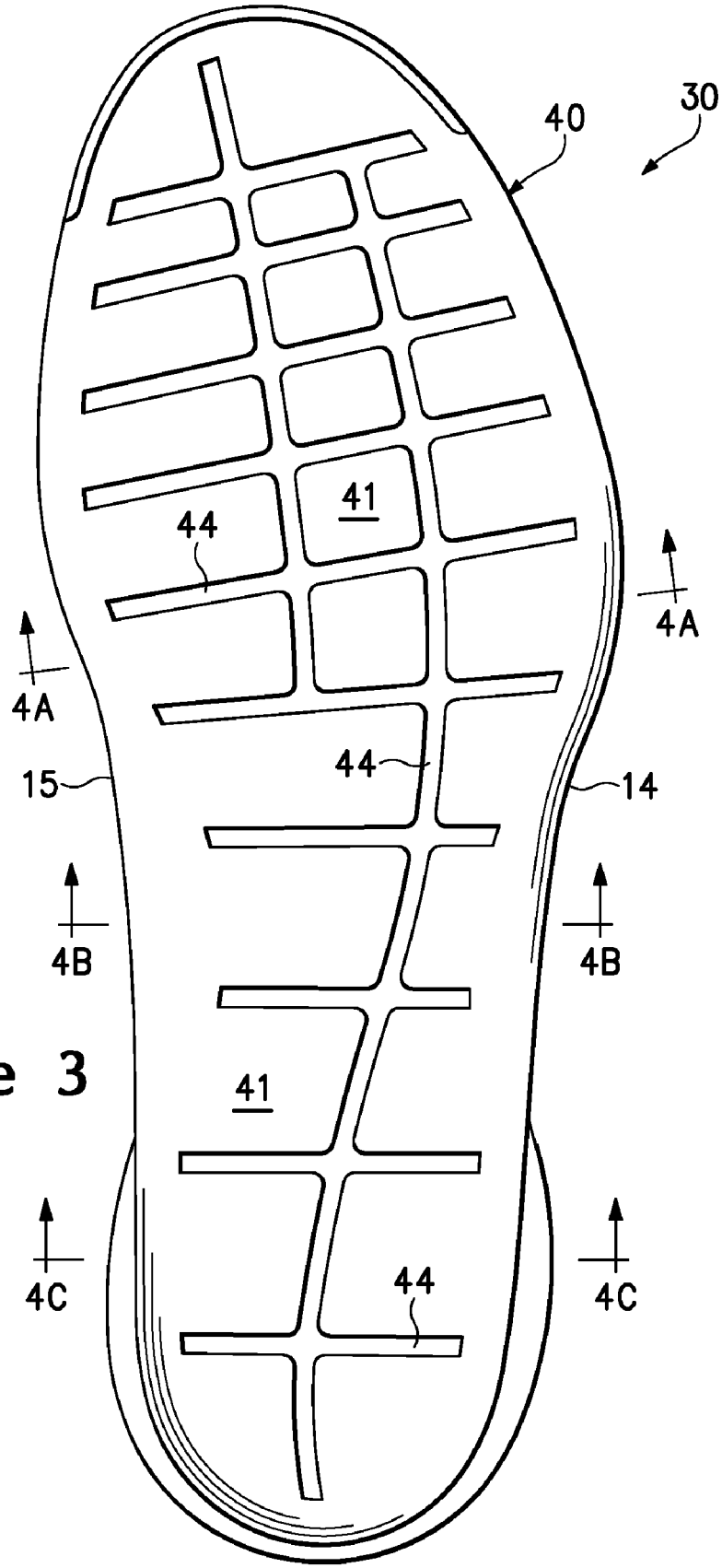
FIG. 3 is a top plan view of a sole structure of the article of footwear.
Figure 4A:
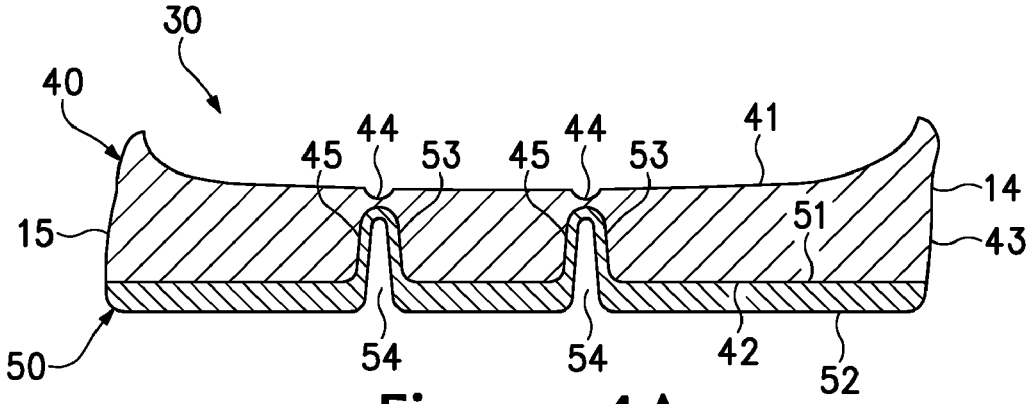
FIGS. 4A-4C are cross-sectional views of the sole structure, as defined by section lines 4A-4C in FIG. 3.
Figure 4B:
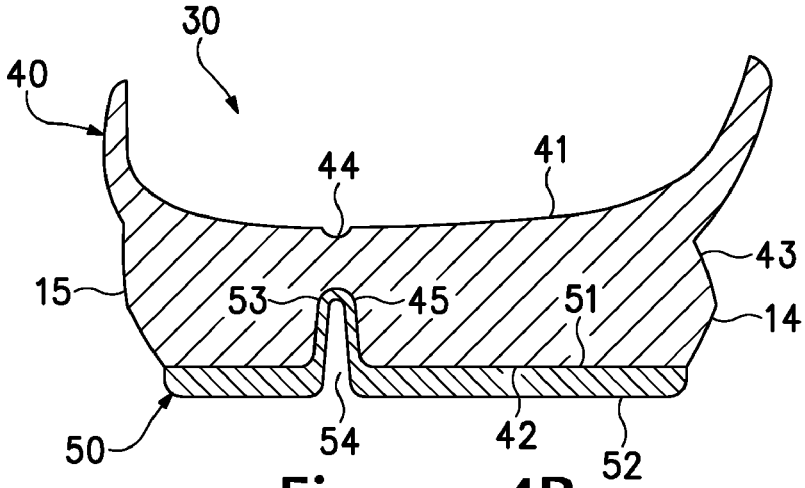
Figure 4C:
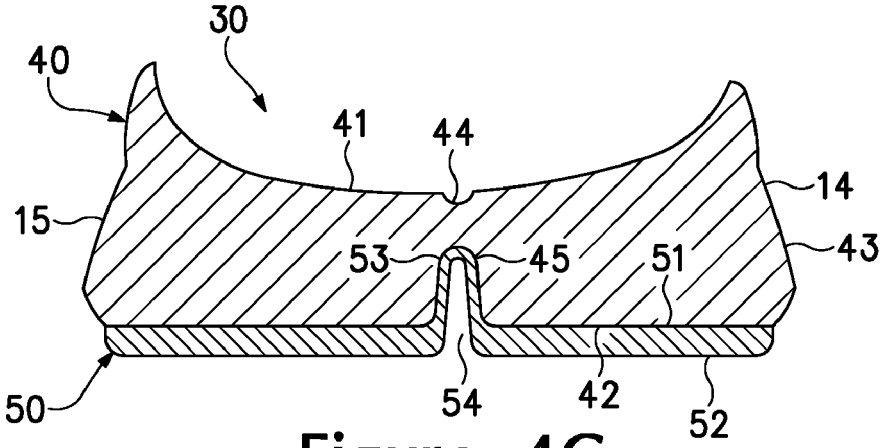
Figure 5:
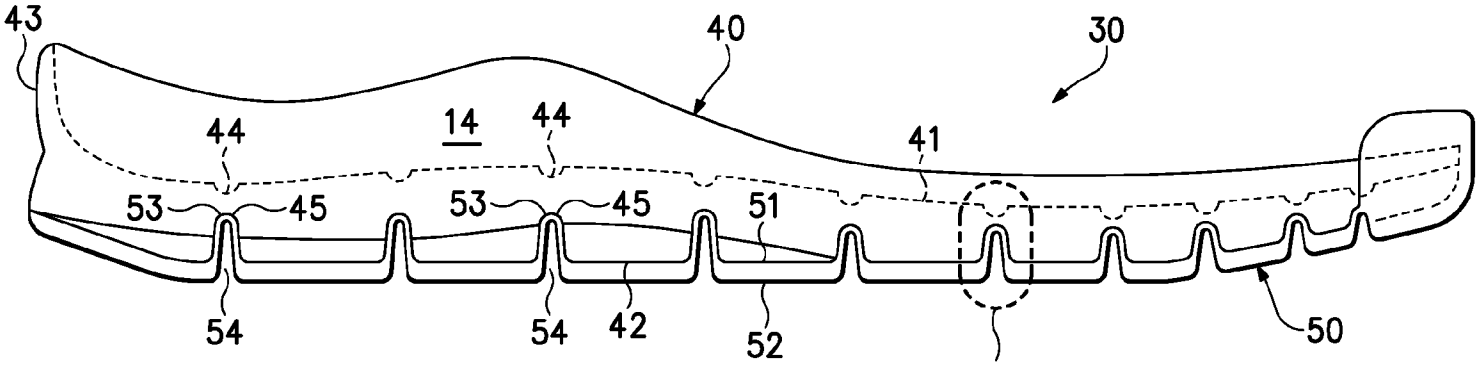
FIG. 5 is a lateral side elevational view of the sole structure.
Figure 6:
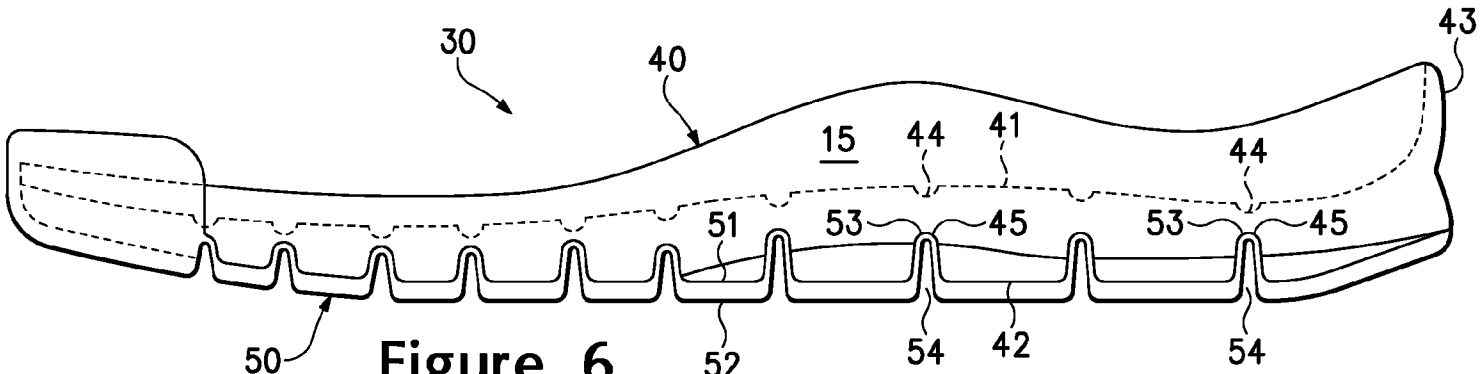
FIG. 6 is a medial side elevational view of the sole structure.

Midsole 40 includes an upper surface 41, an opposite lower surface 42, and a sidewall surface 43 that extends between surfaces 41 and 42. Upper surface 41 is positioned adjacent to upper 20 and defines a plurality of depressions 44*a*, 44*b* and 44*c* that extend downward and toward lower surface 42. Although the locations of depressions 44*a*, 44*b* and 44*c* may vary significantly, a suitable configuration is depicted in FIG. 3. In this configuration, depression 44*a* extends in a generally longitudinal direction and passes through all three of regions 11-13. In forefoot region 11 and midfoot region 12, depression 44*a* is spaced inward from lateral side 14, but is centrally-located in heel region 13. Although depression 44*a* may have a straight or linear configuration, depression 44*a* is depicted as having a generally curved or s-shaped configuration. Depression 44*b* extends in the longitudinal direction and is generally parallel to depression 44*a*. More particularly, depression 44*b* is spaced inward from medial side 15 and passes through forefoot region 11 and into midfoot region 12. A plurality of depressions 44*c* extend between sides 14 and 15 and are distributed in each of regions 11-13. Despite the fact that ten depressions 44*c* are depicted, some configurations of sole structure 30 includes at least two depressions 44*c*. Although depressions 44*c* are generally parallel to each other, the depressions 44*c* in forefoot region 11 and a forward portion of midfoot region 12 are somewhat angled with respect to the depressions 44*c* in a rearward portion of midfoot region 12 and heel region 13.

Figure 8:
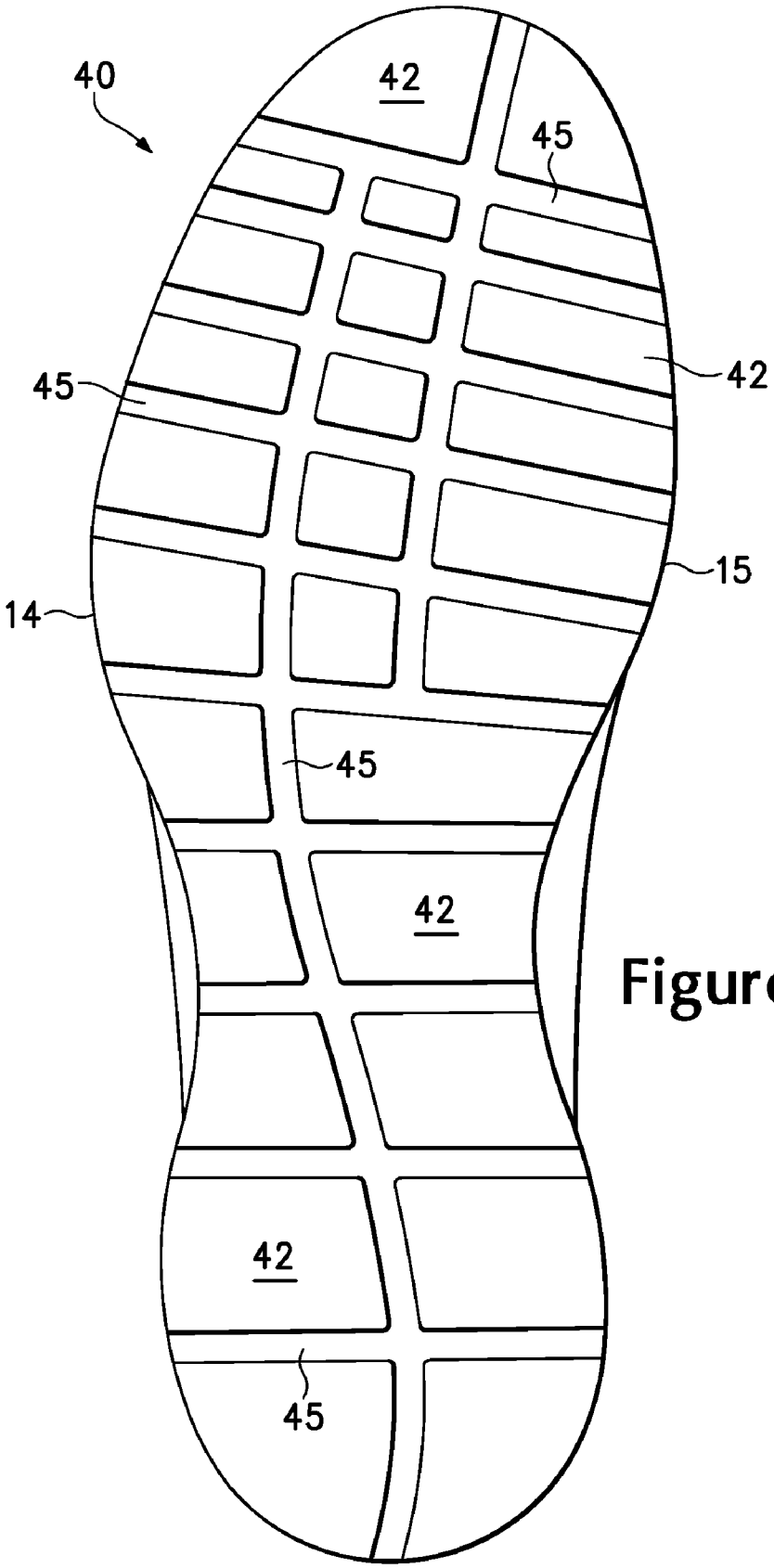
FIG. 8 is a bottom plan view of a midsole of the sole structure.

Lower surface 42, which is depicted in FIG. 8, is positioned adjacent to outsole 50 and defines a plurality of indentations 45*a*, 45*b*, and 45*c* that extend upward and toward upper surface 41. As with depressions 44*a*, 44*b* and 44*c*, the locations of indentations 45*a*, 45*b* and 45*c* may vary significantly. In general, however, indentations 45*a*, 45*b*, and 45*c* are positioned opposite depressions 44*a*, 44*b* and 44*c*. In this configuration, therefore, indentation 45*a* extends in a generally longitudinal direction and passes through all three of regions 11-13. In forefoot region 11 and midfoot region 12, indentation 45*a* is spaced inward from lateral side 14, but is centrally-located in heel region 13. Although indentation 45*a* may have a straight or linear configuration, indentation 45*a* is depicted as having a generally curved or s-shaped configuration. Indentation 45*b* extends in the longitudinal direction and is generally parallel to depression 44*a*. More particularly, indentation 45*b* is spaced inward from medial side 15 and passes through forefoot region 11 and into midfoot region 12. A plurality of indentations 45*c* extend between sides 14 and 15 and are distributed in each of regions 11-13. Despite the fact that ten indentations 45*c* are depicted, some configurations of sole structure 30 includes at least two indentations 45*c*. Although indentations 45*c* are generally parallel to each other, the indentations 45*c* in forefoot region 11 and a forward portion of midfoot region 12 are somewhat angled with respect to the indentations 45*c* in a rearward portion of midfoot region 12 and heel region 13.

As noted above, indentations 45*a*, 45*b*, and 45*c* are positioned opposite depressions 44*a*, 44*b* and 44*c*. In this configuration, depression 44*a* is located above indentation 45*a*, depression 44*b* is located above indentation 45*b*, and the various depressions 44*c* are located above the various indentations 45*c*. In some configurations of footwear 10, however, the locations may not correspond or some or one or more of indentations 45*a*, 45*b*, and 45*c* or depressions 44*a*, 44*b* and 44*c* may be absent from midsole 40.

Although the relative depths of depressions 44*a*, 44*b*, and 44*c* and indentations 45*a*, 45*b*, and 45*c* may vary significantly, depressions 44*a*, 44*b*, and 44*c* are depicted as having a lesser depth than indentations 45*a*, 45*b*, and 45*c*. More particularly, whereas depressions 44*a*, 44*b*, and 44*c* extend through approximately ten percent of a thickness (i.e., distance between surfaces 41 and 42) of midsole 40, the corresponding indentations 45*a*, 45*b*, and 45*c* extend through approximately fifty percent of the thickness of midsole 40. In further configurations of midsole 40, the depth of depressions 44*a*, 44*b*, and 44*c* may range from one to forty percent or more of the thickness of midsole 40, and the depth of indentations 45*a*, 45*b*, and 45*c* in corresponding areas may range from ten to eighty percent or more of the thickness of midsole 40. Accordingly, the depth of depressions 44*a*, 44*b*, and 44*c* and the corresponding indentations 45*a*, 45*b*, and 45*c* may vary significantly, and the depth of depressions 44*a*, 44*b*, and 44*c* may be less than the depth of the corresponding indentations 45*a*, 45*b*, and 45*c* in many configurations of midsole 40.

As with the depths of depressions 44*a*, 44*b*, and 44*c* and indentations 45*a*, 45*b*, and 45*c*, the distance between a lower portion of depressions 44*a*, 44*b*, and 44*c* and an upper portion of indentations 45*a*, 45*b*, and 45*c* may vary. As discussed in greater detail below, depressions 44*a*, 44*b*, and 44*c* and indentations 45*a*, 45*b*, and 45*c* enhance the flexibility of sole structure 30. This distance, therefore, also has an effect upon flexibility. For example, greater flexibility may be present when the distance is relatively small, and lesser flexibility may be present when the distance is relatively large. Although the distance between the lower portion of depressions 44*a*, 44*b*, and 44*c* and the upper portion of indentations 45*a*, 45*b*, and 45*c* may range from zero to twenty millimeters or more, the distance is generally greater than two millimeters in some configurations of midsole 40.

Whereas depressions 44*a*, 44*b*, and 44*c* extend downward from upper surface 41, indentations 45*a*, 45*b*, and 45*c* extend upward from lower surface 42. As discussed above, the locations of depressions 44*a*, 44*b*, and 44*c* and indentations 45*a*, 45*b*, and 45*c* generally correspond with each other. Accordingly, depressions 44*a*, 44*b*, and 44*c* and indentations 45*a*, 45*b*, and 45*c* cooperatively reduce the thickness of midsole 40 in specific areas. In some configurations, the thickness of midsole 40 in the area between lower portions of depressions 44*a*, 44*b*, and 44*c* and upper portions of indentations 45*a*, 45*b*, and 45*c* may be greater than two millimeters. In other configurations, however, depressions 44*a*, 44*b*, and 44*c* and indentations 45*a*, 45*b*, and 45*c* may join each other to form apertures through midsole 40, or the thickness of midsole 40 may be greater than ten millimeters.

Figure 9:
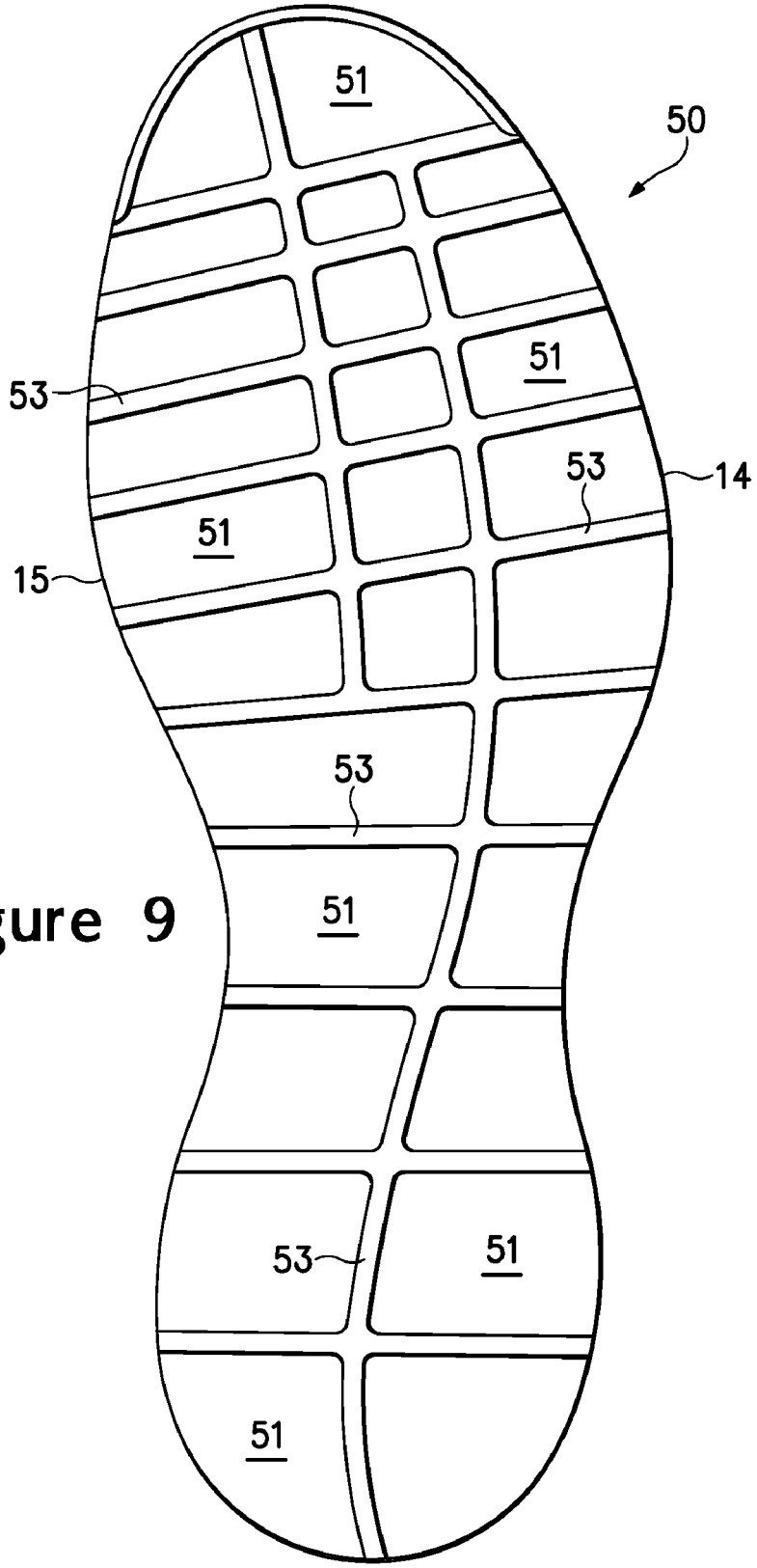
FIG. 9 is a top plan view of an outsole of the sole structure.

Outsole 50 may be produced from a durable and wear-resistant material, such as rubber, that defines an upper surface 51 and an opposite lower surface 52. Upper surface 51 forms an attachment surface that is secured to lower surface 42 of midsole 40 and defines a plurality of projections 53 that respectively extend upward and into indentations 45*a*, 45*b*, and 45*c*, as depicted in FIG. 9. More particularly, projections 53 are positioned to correspond in location with the various indentations 45*a*, 45*b*, and 45*c*, and projections 53 are dimensioned (i.e., shaped and sized) to fit within indentations 45*a*, 45*b*, and 45*c*. An upper area of indentations 45*a*, 45*b*, and 45*c* may have a semi-circular shape, and an upper area of protections 53 may have a corresponding semi-circular shape. Lower surface 52 forms the ground-engaging surface of footwear 10 and defines a plurality of grooves 54*a*, 54*b*, and 54*c* that extend upward and into the various projections 53. That is, grooves 54*a*, 54*b*, and 54*c* are positioned opposite the various projections 53 and have a depth that extends into projections 53.

Figure 7:
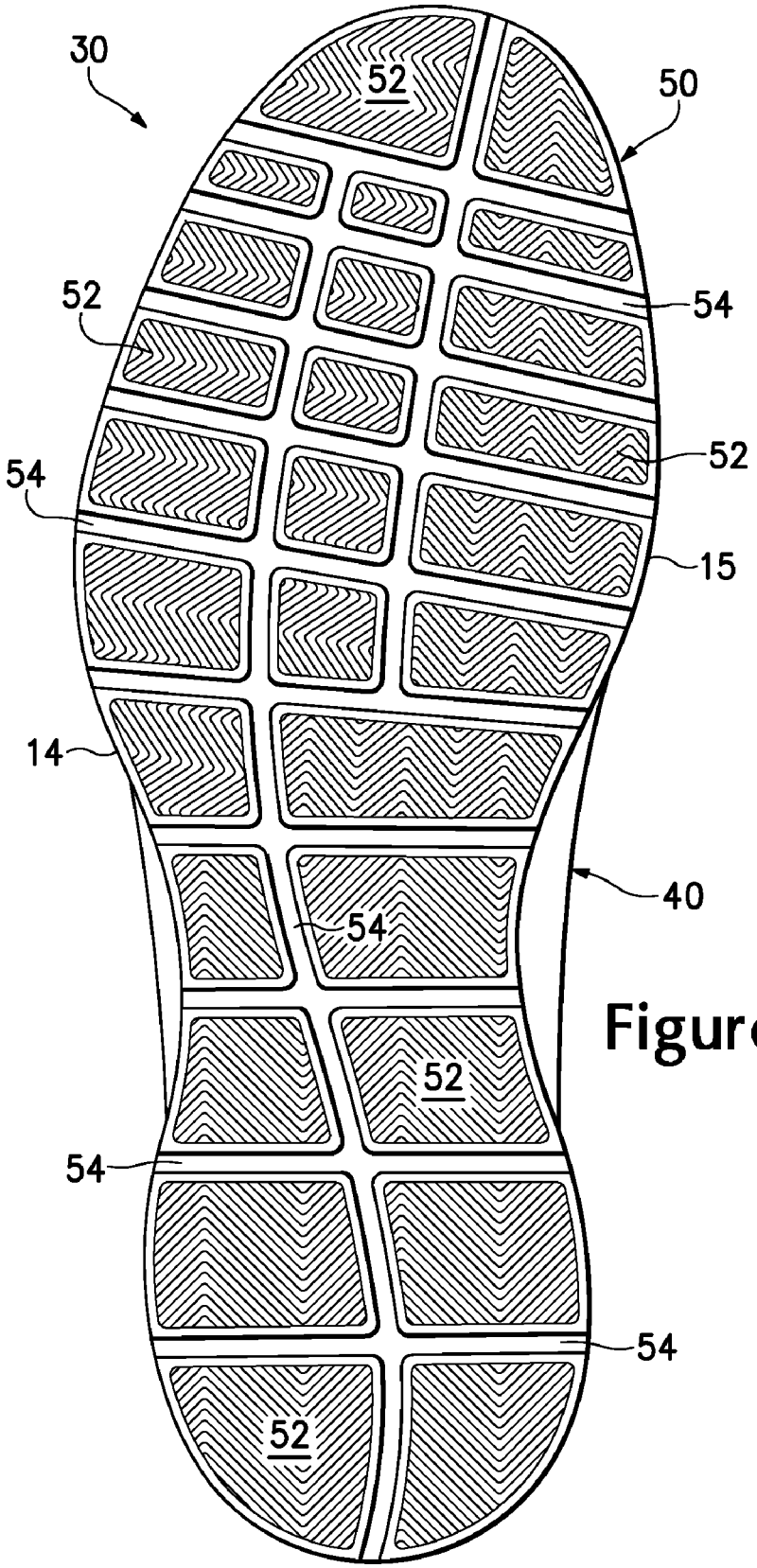
FIG. 7 is a bottom plan view of the sole structure.

Grooves 54*a*, 54*b*, and 54*c* are positioned to correspond in location with indentations 45*a*, 45*b*, and 45*c*, as depicted in FIG. 7. That is, grooves 54*a*, 54*b*, and 54*c* extend upward and into the various indentations 45*a*, 45*b*, and 45*c*. In this configuration, therefore, groove 54*a* extends in a generally longitudinal direction and passes through all three of regions 11-13. In forefoot region 11 and midfoot region 12, groove 54*a* is spaced inward from lateral side 14, but is centrally-located in heel region 13. Although groove 54*a* may have a straight or linear configuration, groove 54*a* is depicted as having a generally curved or s-shaped configuration. Groove 54*b* extends in the longitudinal direction and is generally parallel to groove 54*a*. More particularly, groove 54*b* is spaced inward from medial side 15 and passes through forefoot region 11 and into midfoot region 12. A plurality of grooves 54*c* extend between sides 14 and 15 and are distributed in each of regions 11-13. Despite the fact that ten grooves 54*c* are depicted, some configurations of sole structure 30 includes at least two grooves 54*c*. Although grooves 54*c* are generally parallel to each other, the grooves 54*c* in forefoot region 11 and a forward portion of midfoot region 12 are somewhat angled with respect to the grooves 54*c* in a rearward portion of midfoot region 12 and heel region 13.

The thickness of outsole 50 varies in different areas of sole structure 30. In general, the areas of outsole 50 that form projections 53 exhibit a lesser thickness than the areas of outsole 50 that form the ground-contacting surface. That is, the distance between surfaces 51 and 52 outside of indentations 45*a*, 45*b*, and 45*c* is generally more than the distance between (a) a portion of upper surface 51 that forms projections 53 and (b) a portion of lower surface 42 within grooves 54. An advantage of this configuration, which will become more apparent from the discussion below, is that the reduced thickness within indentations 45*a*, 45*b*, and 45*c* enhances the flexibility of sole structure 30. Furthermore, the increased thickness of the areas of outsole 50 that form the ground-contacting surface permit greater wear as they contact and are abraded against the ground during use of footwear 10. In other configurations, the difference in thicknesses may be reversed or the different areas may have substantially equal thicknesses.

In addition to having lesser thickness, the areas of outsole 50 that form projections 53 form a lesser part of the overall area of lower surface 52 than the areas of outsole 50 that form the ground-contacting surface. In general, indentations 45*a*, 45*b*, and 45*c* cover between five percent and thirty percent of the total area of lower surface 42. The portions of outsole 50 that extend into indentations 45*a*, 45*b*, and 45*c* (i.e., projections 53 and grooves 54*a*, 54*b*, and 54*c*) also form, therefore, a relatively small part of the total surface area of lower surface 52. Accordingly, a majority of lower surface 52 forms a contact area with the ground, and a minority of lower surface 52 forms portions of outsole 50 that extend into midsole 40.

Depressions 44*a*, 44*b*, and 44*c*; indentations 45*a*, 45*b*, and 45*c*; and grooves 54*a*, 54*b*, and 54*c* enhance the flexibility of sole structure 30 by forming an articulated configuration in sole structure 30. That is, depressions 44*a*, 44*b*, and 44*c*; indentations 45*a*, 45*b*, and 45*c*; and grooves 54*a*, 54*b*, and 54*c* form flexion lines in sole structure 30 that increase the overall flexibility of sole structure 30. Lateral flexibility of sole structure 30 (i.e., flexibility in a direction that extends between lateral side 14 and medial side 15) is provided by the combinations of (a) depression 44*a*, indentation 45*a*, and groove 54*a* and (b) depression 44*b*, indentation 45*b*, and groove 54*b*. Longitudinal flexibility of sole structure 30 (i.e., flexibility in a direction that extends between regions 11 and 13) is provided by the combinations of the various depressions 44*c*, indentations 45*c*, and grooves 54*c* and are distributed in each of regions 11-13.

The positions and orientations of depressions 44*a*, 44*b*, and 44*c*; indentations 45*a*, 45*b*, and 45*c*; and grooves 54*a*, 54*b*, and 54*c* are selected to complement the natural motion of the foot during the running cycle. In general, the motion of the foot during running proceeds as follows: Initially, the heel strikes the ground, followed by the ball of the foot. As the heel leaves the ground, the foot rolls forward so that the toes make contact, and finally the entire foot leaves the ground to begin another cycle. During the time that the foot is in contact with the ground, the foot typically rolls from the outside or lateral side to the inside or medial side, a process called pronation. That is, normally, the outside of the heel strikes first and the toes on the inside of the foot leave the ground last. The combinations of (a) depression 44*a*, indentation 45*a*, and groove 54*a* and (b) depression 44*b*, indentation 45*b*, and groove 54*b* provide lateral flexibility (i.e., the two flexion structures extending in the longitudinal direction) to permit the foot to pronate naturally during the running cycle. The combinations of the various depressions 44*c*, indentations 45*c*, and grooves 54*c* provide longitudinal flexibility (i.e., the various flexion structures extending between sides 14 and 15) to ensure that the foot remains in a neutral foot-strike position and complement the neutral forward roll of the foot as it is in contact with the ground.

Figure 10A:
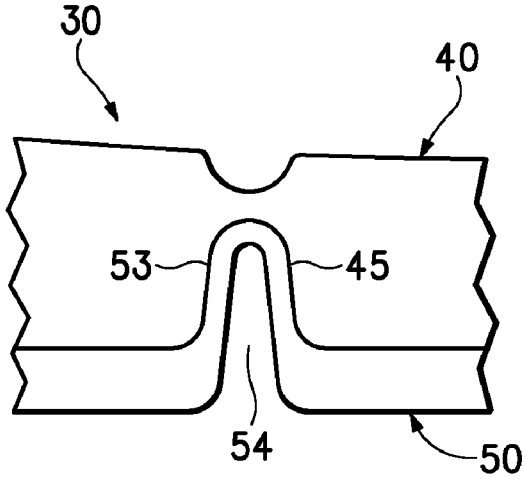
FIGS. 10A-10C are lateral side elevational views of a portion of the sole structure, as defined in FIG. 5.
Figure 10B:
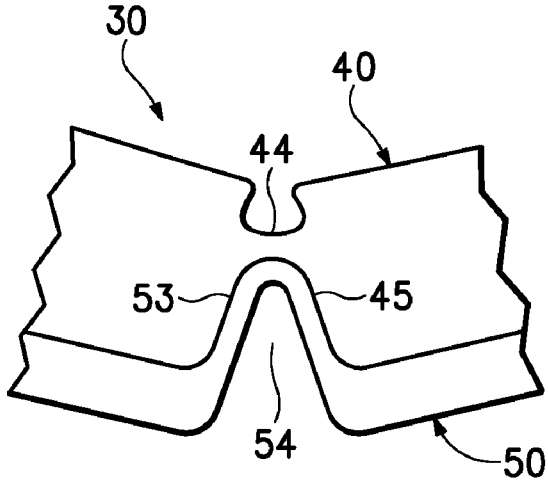
Figure 10C:
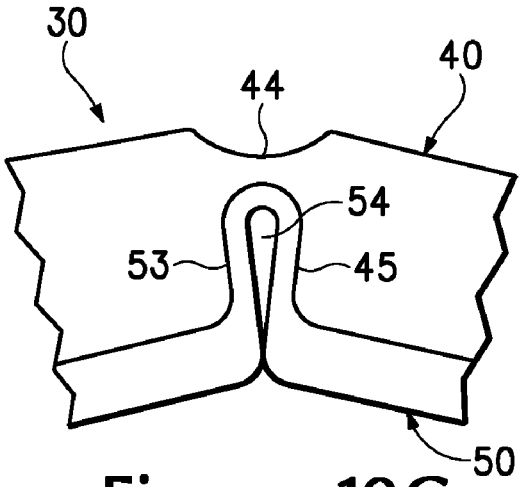

Referring to FIG. 10A, a portion of sole structure 30 having one of depressions 44*c*, indentations 45*c*, and grooves 54*c* is depicted in a non-flexed state. That is, sole structure 30 is in a state wherein no forces are acting to bend or otherwise flex sole structure 30. Referring to FIG. 10B, the portion of sole structure 30 is depicted in an upwardly-flexed state, in which depression 44*c*, indentation 45*c*, and groove 54*c* form a flexion line that facilitates the upward flexing of sole structure 30. Similarly, depression 44*c*, indentation 45*c*, and groove 54*c* form a flexion line that facilitates the upward flexing of sole structure 30, as depicted in FIG. 10C.

Figure 11A:
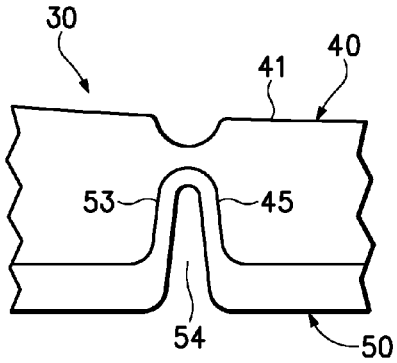
FIGS. 11A and 11B are lateral side elevational views of the portion of the sole structure, as defined in FIG. 5.
Figure 11B:
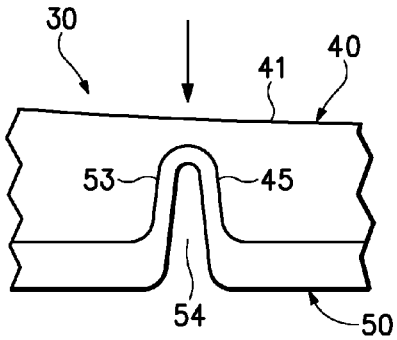

In addition to facilitating flex in sole structure 30, depressions 44*a*, 44*b*, and 44*c* also enhance the comfort of footwear 10. As discussed above, midsole 40 may be formed from a polymer foam material, whereas outsole 50 may be formed from a rubber material. One difference between these materials relates to compressibility. More particularly, the polymer foam material is more compressible than the rubber material. When compressed, areas of sole structure 30 having projections 53 may compress less than areas of sole structure 30 where projections 53 are absent. Referring to FIG. 11A, the portion of sole structure 30 having one of depressions 44*c*, indentations 45*c*, and grooves 54*c* is depicted in a non-compressed state. When compressed, as depicted in FIG. 11B, the areas where projections 53 are absent may compress more than the area having projection 53, thereby decreasing the depth of depression 44*c*.

Figure 12A:
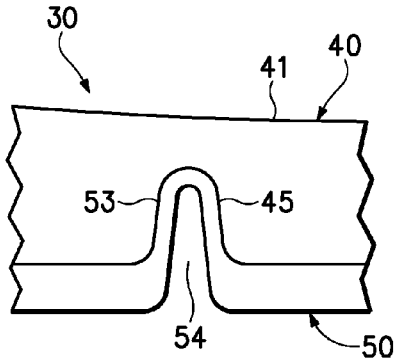
FIGS. 12A and 12B are lateral side elevational views corresponding with FIGS. 11A-11B and depicting an alternate configuration.
Figure 12B:
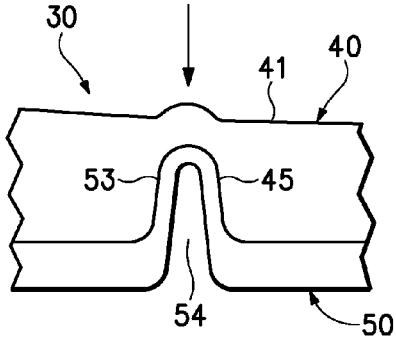

As a comparison, a configuration wherein depression 44*c* is absent is depicted in FIGS. 12A and 12B. FIG. 12A depicts the portion of sole structure 30 in a non-compressed state, and upper surface 41 has a substantially flat configuration. In FIG. 12B, however, the portion of sole structure 30 is compressed and projection 53 creates an upward bulge on upper surface 41, which may cause discomfort to the foot during walking and running. Depressions 44*a*, 44*b*, and 44*c* assist, therefore, in mitigating the perception of pressure that the foot may feel due to the recessed projections 53 in midsole 40.

Although depressions 44*a*, 44*b*, and 44*c* may impart greater comfort to footwear 10, depressions 44*a*, 44*b*, and 44*c* may be absent in other configurations of footwear 10. For example, depressions 44*a*, 44*b*, and 44*c* may be absent when (a) when the compressibilities of the materials forming midsole 40 and outsole 50 do not form significant bulges on the upper surface, (b) the thickness of midsole 40 above indentations 45*a*, 45*b*, and 45*c* is sufficient to minimize or eliminate the bulges, or (c) a plate or other member extends between the foot and midsole 40. Depressions 44*a*, 44*b*, and 44*c* may, therefore, be absent in various configurations of footwear 10. Moreover, depressions 44*a*, 44*b*, and 44*c* may only be absent from midfoot region 12, for example, in some configurations, thereby leaving only the depressions 44*a*, 44*b*, and 44*c* in regions 11 and 13. Accordingly, depressions 44*a*, 44*b*, and 44*c* may be present throughout upper surface 41, entirely absent from upper surface 41, or absent from only a portion of upper surface 41 in different configurations of footwear 10.

Manufacturing Process

Midsole 40 and outsole 50 may be manufactured through a plurality of conventional molding processes, including injection molding and casting, for example. Although the sides of indentations 45*a*, 45*b*, and 45*c*, projections 53, and grooves 54*a*, 54*b*, and 54*c* may be substantially vertical, midsole 40 and outsole 50 may be removed from molds more efficiently if an angle of less than 85 degrees, for example, is utilized.

Figure 13A:
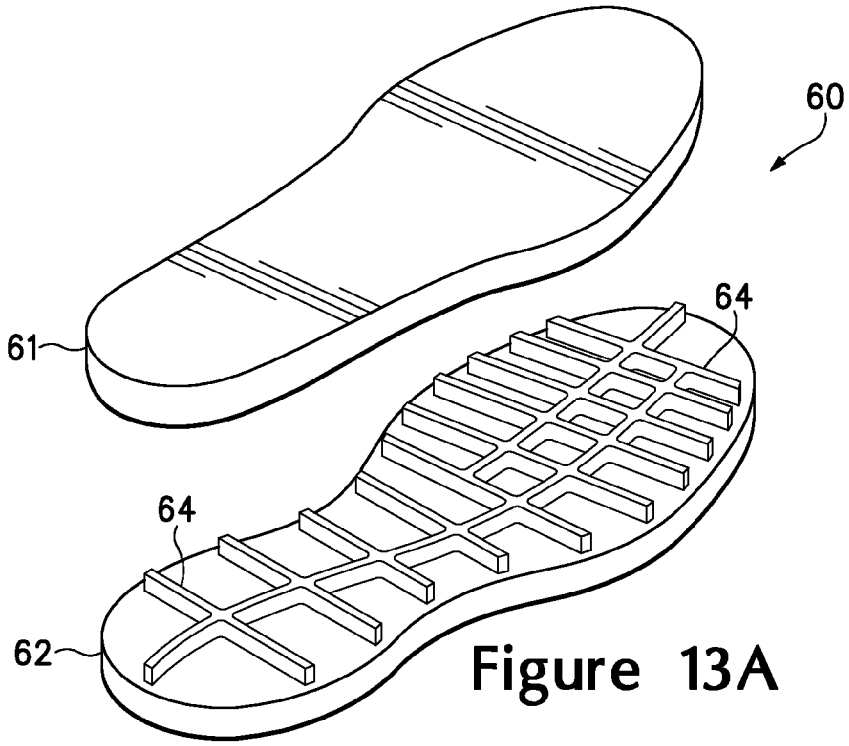
FIGS. 13A and 13B are a perspective views of a mold for joining elements of the sole structure.
Figure 13B:
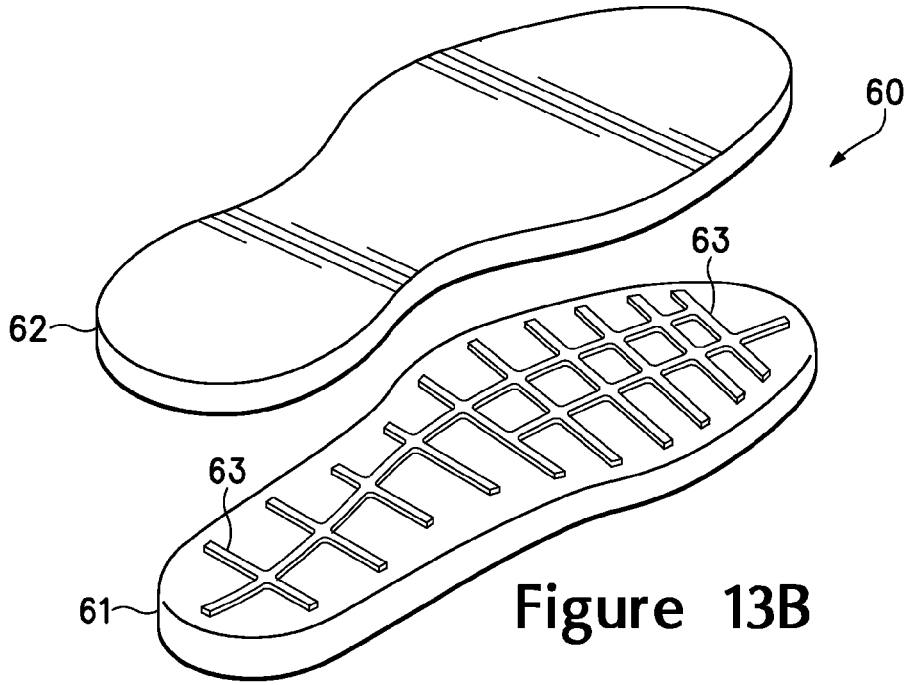

A mold 60 for assembling sole structure 30 is depicted in FIGS. 13A and 13B. Mold 60 includes a midsole portion 61 and an outsole portion 62. A lower surface of midsole portion 61 is contoured to correspond with the shape of upper surface 41 and has various protrusions 63 that engage depressions 44*a*, 44*b*, and 44*c*. An upper surface of outsole portion 62 is contoured to correspond with the shape of lower surface 52 and has various protrusions 64 that engage grooves 54*a*, 54*b*, and 54*c*.

Figure 14A:
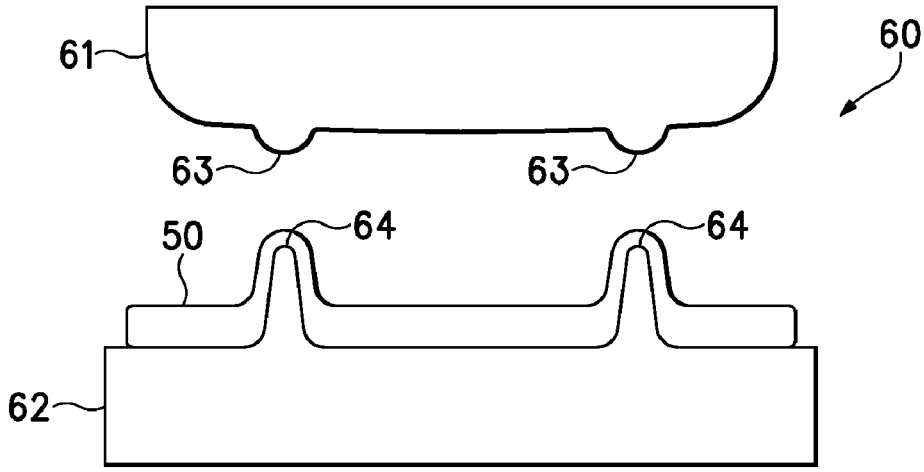
FIGS. 14A-14E are schematic front elevational views of a method of assembling the elements of the sole structure with the mold.
Figure 14B:
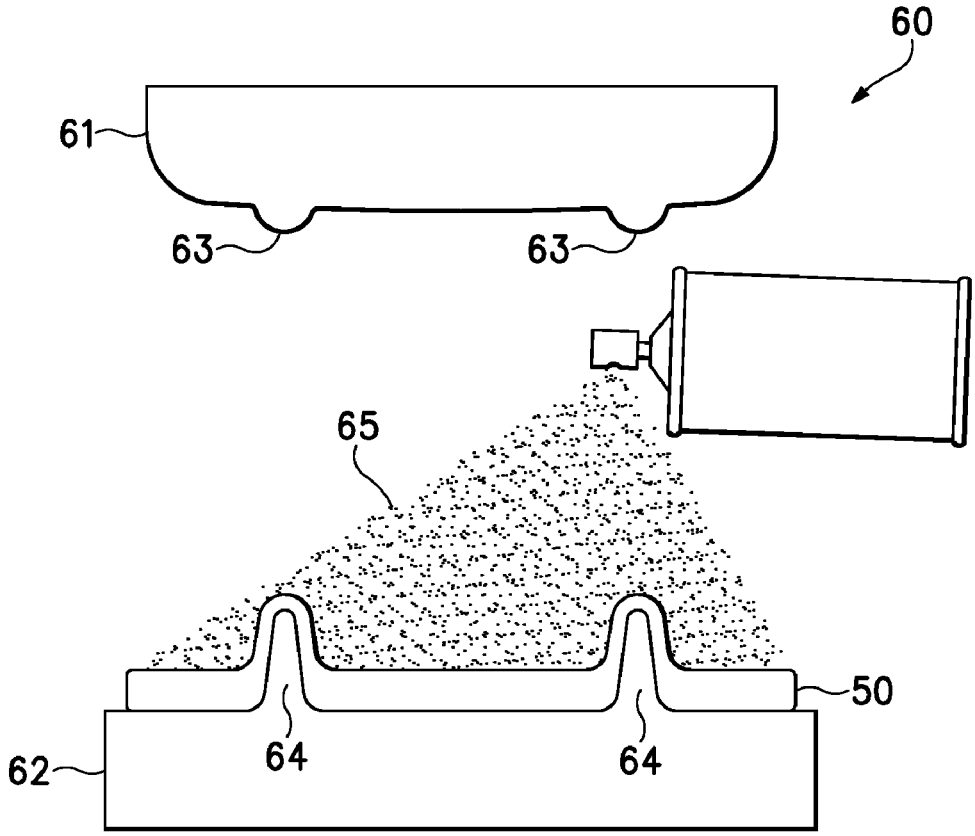
Figure 14C:
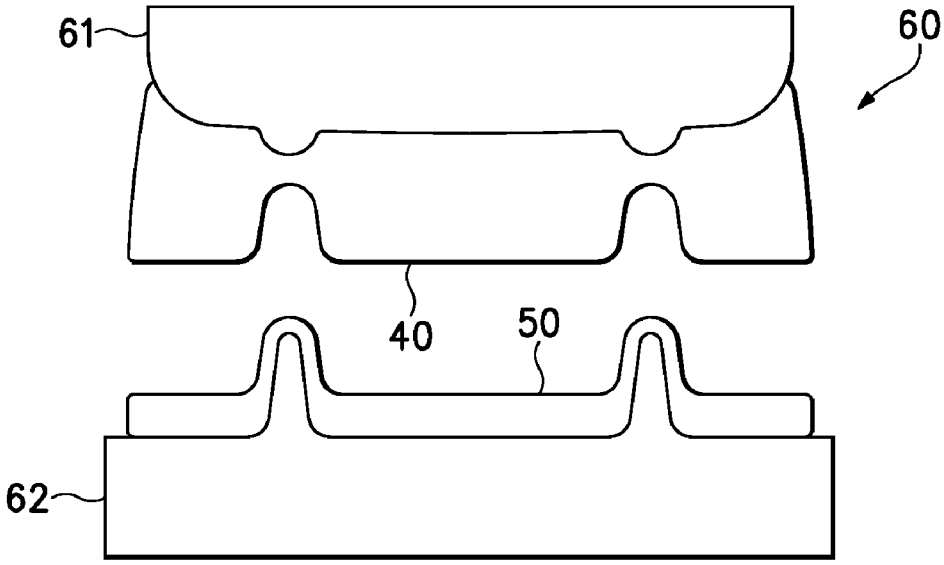
Figure 14D:
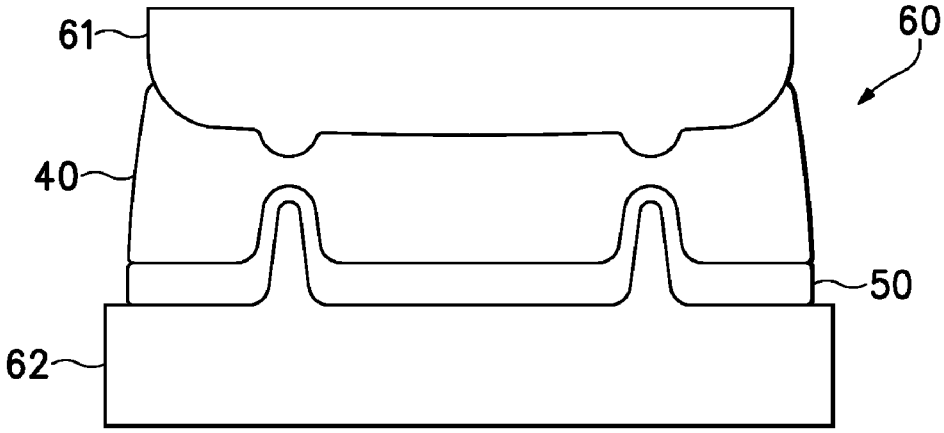
Figure 14E:
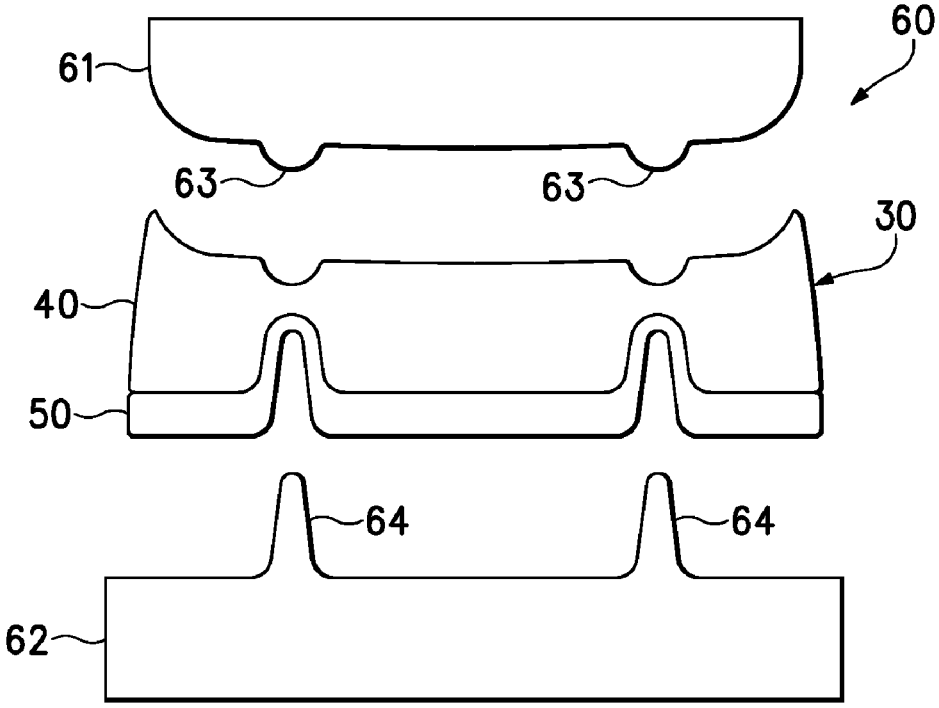

In utilizing mold 60 to assemble sole structure 30, outsole 50 is located in outsole portion 62 such that protrusions 64 extend into grooves 54*a*, 54*b*, and 54*c*, as depicted in FIG. 14A. In circumstances where an adhesive is utilized to join midsole 40 and outsole 50, an adhesive 65 is applied to upper surface 51, as depicted in FIG. 14B. As an alternative, adhesive 65 may be applied to lower surface 42 or both of surfaces 42 and 51. Once adhesive 65 is applied, midsole 40 is located adjacent to midsole portion 61 such that protrusions 63 extend into depressions 44*a*, 44*b*, and 44*c*, as depicted in FIG. 14C. Midsole 40 and outsole 50 are then brought into contact such that (a) projections 53 extend into indentations 45*a*, 45*b*, and 45*c* and (b) potions 61 and 62 compress midsole 40 and outsole 50 together, as depicted in FIG. 14D. Once midsole 40 and outsole 50 are secured together, sole structure 30 may be removed from mold 60, as depicted in FIG. 14E.

CONCLUSION

Figure 15:
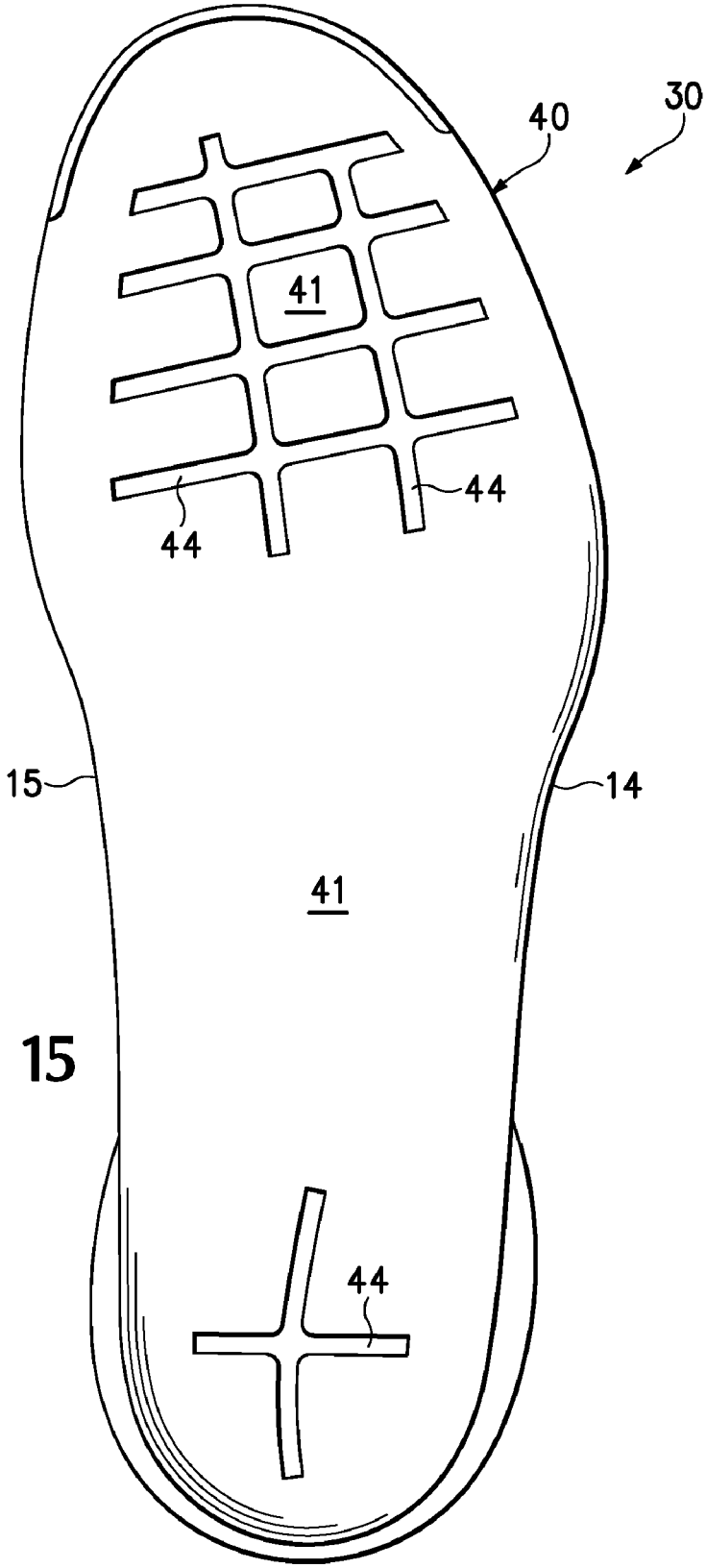
FIG. 15 is a top plan view of another configuration of the sole structure.

Although the configuration of footwear 10 discussed above and depicted in the figures provides a suitable configuration, a variety of alternative configurations may also be utilized. For example, depressions 44*a*, 44*b*, and 44*c*; indentations 45*a*, 45*b*, and 45*c*; and grooves 54*a*, 54*b*, and 54*c* may be located in other areas of sole structure 30. As discussed above, depressions 44*a*, 44*b*, and 44*c* may be present throughout upper surface 41, entirely absent from upper surface 41, or absent from only a portion of upper surface 41 in different configurations of footwear 10. Referring to FIG. 15, a configuration is depicted wherein depressions 44*a*, 44*b*, and 44*c* are absent in midfoot region 12. In other configurations, indentations 45*a*, 45*b*, and 45*c* or grooves 54*a*, 54*b*, and 54*c* may also be absent in midfoot region 12 or any of regions 11-13.

The invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

The invention claimed is:

1. An article of footwear having an upper and a sole structure secured to the upper, the sole structure comprising:

a midsole formed from a polymer foam material and having an upper surface and an opposite lower surface, the upper surface being positioned adjacent to the upper, the lower surface defining a plurality of indentations extending toward the upper surface, and the upper surface defining a plurality of depressions located opposite at least a portion of the indentations; and an outsole having an attachment surface and an opposite ground-engaging surface, the attachment surface being secured to the lower surface of the midsole, and the attachment surface forms a plurality of projections that extend into the indentations of the midsole, and the ground-engaging surface defining a plurality of grooves located opposite the projections.

2. The article of footwear recited in claim 1, wherein a depth of the depressions is less than a depth of the indentations.

3. The article of footwear recited in claim 1, wherein at least a portion of the indentations extend through more than half of a distance between the lower surface and the upper surface.

4. The article of footwear recited in claim 1, wherein an upper portion of the indentations and an upper portion of the projections each have a semi-circular shape.

5. The article of footwear recited in claim 1, wherein the indentations include:

a first indentation that extends through substantially all of a length of the sole structure; and at least two second indentations that extend through substantially all of a width of the sole structure.

6. The article of footwear recited in claim 1, wherein the indentations include:

a first indentation that extends through substantially all of a length of the sole structure;

a second indentation that extends through a portion of the length of the sole structure; and at least two third indentations that extend through substantially all of a width of the sole structure.

7. The article of footwear recited in claim 1, wherein the indentations include:

a first indentation that extends through substantially all of a length of the sole structure, the first indentation being located closer to a lateral side of the footwear than a medial side of the footwear in a forefoot region of the sole structure, and the first indentation being centrally-located between the lateral side and the medial side in a heel region of the sole structure;

a second indentation that extends through a portion of the length of the sole structure and is located closer to the medial side than the first indentation in at least a forefoot region of the sole structure; and at least two third flexion indentations that extend between the lateral side and the medial side of the sole structure.

8. The article of footwear recited in claim 1, wherein the upper surface of the midsole defines a plurality of depressions, the depressions including:

a first depression that extends through substantially all of a length of the sole structure;

a second depression that extends through a portion of the length of the sole structure; and at least two third depressions that extend through substantially all of a width of the sole structure, and wherein the indentations include:

a first indentation that extends through substantially all of the length of the sole structure and is opposite the first depression;

a second indentation that extends through a portion of the length of the sole structure and is opposite the second depression; and at least two third indentations that extend through substantially all of the width of the sole structure and are opposite the third depression.

9. The article of footwear recited in claim 1, wherein the outsole is formed from a material that is different than the polymer foam material of the midsole, and a compressibility of the outsole material is less than a compressibility of the polymer foam material.

10. The article of footwear recited in claim 1, wherein the outsole has a first thickness within the indentations and a second thickness outside of the indentations, the first thickness being less than the second thickness.

11. An article of footwear having an upper and a sole structure secured to the upper, the sole structure comprising:

a midsole formed from a first material and having an upper surface and an opposite lower surface, the upper surface defining a plurality of depressions extending toward the lower surface, and the lower surface defining a plurality of indentations extending toward the upper surface, at least a portion of the depressions being positioned opposite the indentations, and a depth of the depressions being less than a depth of the indentations; and an outsole formed from a second material and at least partially located within the indentations, a compressibility of the second material being less than a compressibility of the first material.

12. The article of footwear recited in claim 11, wherein the first material is a polymer foam and the second material is rubber.

13. The article of footwear recited in claim 12, wherein the midsole is a unitary element of the polymer foam material.

14. The article of footwear recited in claim 11, wherein a ground-engaging surface of the outsole defines a plurality of grooves that extend into the indentations of the midsole.

15. The article of footwear recited in claim 14, wherein the outsole has a first thickness within the indentations and a second thickness outside of the indentations, the first thickness being less than the second thickness.

16. The article of footwear recited in claim 11, wherein at least a portion of the indentations extend through more than half of a distance between the lower surface and the upper surface.

17. The article of footwear recited in claim 11, wherein an upper portion of the indentations and an upper portion of the projections each have a semi-circular shape.

18. The article of footwear recited in claim 11, wherein the depressions include:

a first depression that extends through substantially all of a length of the sole structure; and at least two second depressions that extend through substantially all of a width of the sole structure, and wherein the indentations include:

a first indentation that extends through substantially all of the length of the sole structure and is positioned opposite the first depression; and at least two second indentations that extend through substantially all of the width of the sole structure and are positioned opposite the second depressions.

19. The article of footwear recited in claim 11, wherein the depressions include:

a first depression that extends through substantially all of a length of the sole structure;

a second depression that extends through a portion of the length of the sole structure; and at least two third depressions that extend through substantially all of a width of the sole structure, and wherein the indentations include:

a first indentation that extends through substantially all of the length of the sole structure and is opposite the first depression;

a second indentation that extends through a portion of the length of the sole structure and is opposite the second depression; and at least two third indentations that extend through substantially all of the width of the sole structure and are opposite the third depression.

20. An article of footwear having an upper and a sole structure secured to the upper, the sole structure comprising:

a midsole formed from a first material and having an upper surface and an opposite lower surface, the upper surface defining a plurality of depressions extending toward the lower surface, the depressions including:

(a) a first depression that extends through substantially all of a length of the sole structure, and (b) at least two second depressions that extend through substantially all of a width of the sole structure, and the lower surface defining a plurality of indentations extending toward the upper surface, the indentations including:

(a) a first indentation that extends through substantially all of the length of the sole structure and is positioned opposite the first depression, and (b) at least two second indentations that extend through substantially all of the width of the sole structure and are positioned opposite the second depressions; and an outsole formed from a second material that is less compressible than the first material, the outsole defining a plurality of projections that extend into the indentations of the midsole, and the outsole defining a plurality of grooves located opposite the projections, the grooves including:

(a) a first groove that extends through substantially all of the length of the sole structure and is positioned to extend into the first indentation, and (b) at least two second grooves that extend through substantially all of the width of the sole structure and are positioned to extend into the second indentations.

21. The article of footwear recited in claim 20, wherein a depth of the depressions is less than a depth of the indentations.

22. The article of footwear recited in claim 20, wherein at least a portion of the indentations extend through more than half of a distance between the lower surface and the upper surface.

23. The article of footwear recited in claim 20, wherein an upper portion of the indentations and an upper portion of the projections each have a semi-circular shape.

24. The article of footwear recited in claim 20, wherein the first material is a polymer foam and the second material is rubber.

25. An article of footwear having an upper and a sole structure secured to the upper, the sole structure comprising:

a polymer foam element having a first surface and a second surface located opposite each other, the first surface and the second surface each defining a plurality of flexion lines located opposite each other; and an outsole member secured to the foam element and defining a plurality of protrusions that extend into the flexion lines, the outsole member defining a plurality of grooves located opposite the protrusions and extending into the protrusions.

26. The article of footwear recited in claim 25, wherein the flexion lines have different depths.

27. The article of footwear recited in claim 25, wherein at least a portion of the flexion lines extend through more than half of a distance between the first surface and the second surface.

28. The article of footwear recited in claim 25, wherein at least a portion of the flexion lines have a semi-circular shape.

29. The article of footwear recited in claim 25, wherein the flexion lines include:

a first flexion line that extends through substantially all of a length of the sole structure; and at least two second flexion lines that extend through substantially all of a width of the sole structure.

30. The article of footwear recited in claim 25, wherein the midsole is a unitary element of the polymer foam material.

31. The article of footwear recited in claim 25, wherein the outsole has a first thickness within the flexion lines and a second thickness outside of the flexion lines, the first thickness being less than the second thickness.

32. An article of footwear having an upper and a sole structure secured to the upper, the sole structure comprising:

a midsole formed from a unitary element of a polymer foam material and having an upper surface and an opposite lower surface, the upper surface being positioned adjacent to the upper, the lower surface defining a plurality of flexion lines, and the upper surface defining a plurality of depressions located opposite at least a portion of the flexion lines; and an outsole secured to the midsole and having a ground-engaging surface, the, outsole defining a plurality of grooves that extend upward from the ground-engaging surface to contact the flexion lines, a portion of the outsole with the grooves having a first thickness, and a portion of the outsole separate from the grooves having a second thickness, the first thickness being less than the second thickness.

33. The article of footwear recited in claim 32, wherein a depth of the depressions is less than a depth of the flexion lines.

34. The article of footwear recited in claim 32, wherein at least a portion of the flexion lines extend through more than half of a distance between the lower surface and the upper surface.

35. The article of footwear recited in claim 32, wherein the flexion lines include:

a first flexion line that extends through substantially all of a length of the sole structure; and at least two second flexion lines that extend through substantially all of a width of the sole structure.

* * * * *